US005438158A

United States Patent [19]

Riboloff

[11] Patent Number: 5,438,158

[45] Date of Patent: Aug. 1, 1995

[54] PICKUP, INCLUDING MOUNTING APPARATUS THEREOF, FOR A STRINGED MUSICAL INSTRUMENT HAVING A SOUNDHOLE

[75] Inventor: John T. Riboloff, Antioch, Tenn.

[73] Assignee: Gibson Guitar Corp., Nashville, Tenn.

[21] Appl. No.: 209,646

[22] Filed: Mar. 10, 1994

[51] Int. Cl.[6] ..... G10D 1/08; G10D 3/00; G10H 3/18

[52] U.S. Cl. ..... 84/727; 84/743; 84/267

[58] Field of Search ..... 84/723–743, 84/267–275

[56] References Cited

U.S. PATENT DOCUMENTS

| | | | |
|---|---|---|---|
| 4,748,886 | 6/1988 | De Byl | 84/723 |
| 4,774,867 | 10/1988 | Fishman | 84/731 |
| 4,941,389 | 7/1990 | Wendler | 84/727 |
| 4,944,209 | 7/1990 | Fishman | 84/731 |
| 5,031,501 | 7/1991 | Ashworth | 84/723 |

*Primary Examiner*—Stanley J. Witkowski

*Attorney, Agent, or Firm*—Dougherty, Hessin, Beavers & Gilbert

[57] ABSTRACT

An apparatus for mounting a pickup on a stringed musical instrument having a soundhole has a pickup housing which is adapted to be disposed in the soundhole of the instrument. An abutment member is connected by a threaded rod and an operator member to the pickup housing. The operator member is mounted on the rod and the abutment member so that operation of the operator member moves the abutment member along the rod into abutting engagement with the instrument when the pickup housing is disposed in the soundhole and the operator member is operated. This can form part of an electromagnetic pickup which defines a first magnetic pole beneath a first plurality of the strings of the instrument and which also defines a second magnetic pole beneath a second plurality of the strings of the instrument, wherein the second plurality is less than the first plurality. This enables a balanced electrically amplified output to be obtained from an instrument having its strings made of different materials (for example, brass or bronze wrapped steel E, A, D and G strings and bare steel B and E strings of a six-string acoustic guitar).

19 Claims, 3 Drawing Sheets

PICKUP, INCLUDING MOUNTING APPARATUS THEREOF, FOR A STRINGED MUSICAL INSTRUMENT HAVING A SOUNDHOLE

BACKGROUND OF THE INVENTION

This invention relates generally to enabling the amplification of sound from a stringed musical instrument having a soundhole. In one particular aspect, the invention relates to an apparatus for mounting a pickup on such an instrument. In another particular aspect, the invention relates to an overall electromagnetic pickup assembly for such an instrument.

Many types of stringed musical instruments have been adapted so that their sounds can be electrically amplified. Some types, such as electric guitars, are made specifically for this use. Others, such as acoustic guitars, are not inherently made for this use, but adaptive devices have been proposed or made so that the sound from even such "non-electric" instruments can be electrically amplified. For example, the sound from an acoustic guitar can be amplified by playing the guitar next to a conventional microphone connected in an amplification system. Devices can also be incorporated in or attached to the "non-electric" instrument. It is to the attachment type of device that the present invention is directed.

A stringed instrument that is specifically made for electrical amplification is typically constructed to enable or enhance the amplification process. For example, in an electric guitar having one or more electromagnetic pickups, all the strings are typically bare steel strings so that each readily interacts with one or more magnetic fields set up by one or more magnets in the pickup(s). This may not, however, be the case with a "non-electric" instrument, such as an acoustic guitar.

One type of an acoustic guitar, for example, has strings made of different materials and these materials interact differently with magnetic fields. On a six-string acoustic guitar, the higher pitch B and E strings are bare steel whereas the lower pitch E, A, D and G strings are brass or bronze wrapped steel strings. Either of the bare steel strings affects a magnetic field more than any of the wrapped strings does. This presents a problem to a device used for electrically amplifying the sound from this type of instrument; namely, how to overcome or counteract this difference in the magnetic interaction of the strings so that a balanced output can be provided.

SUMMARY OF THE INVENTION

The present invention provides a novel and improved apparatus for mounting a pickup in a soundhole of a stringed musical instrument. An advantage of this apparatus is that it can fit in different sizes of soundholes so that a specific unit of the invention can be used with different instruments. Other advantages are that this apparatus is easy to use and does not require structural or permanent modification of the instrument. It also does not adversely affect the manner of playing the instrument.

The present invention also provides a novel and improved electromagnetic pickup for a stringed musical instrument. An overall pickup assembly preferably but not necessarily includes the aforementioned mounting apparatus. In a particular implementation, he invention provides an adjustable electromagnetic pickup for an acoustic guitar having six strings of different pitch, wherein the two highest pitch strings are bare steel strings and the four lowest pitch strings are brass or bronze wrapped steel strings, and further wherein the pickup produces a balanced response to all six strings by providing an increased magnetic field for the four lowest pitch strings (i.e., the wrapped strings) and a decreased magnetic field for the two highest pitch strings (i.e., the bare strings). This provides a balanced output from the aforementioned different types of strings. A particular non-limiting implementation of this invention provides for a high output and a hum-canceling mode.

The apparatus for mounting a pickup on a stringed musical instrument having a soundhole comprises a pickup housing adapted to receive a musical instrument pickup device and further adapted to be disposed in the soundhole of the instrument. The apparatus also comprises an abutment member and adjustment means for connecting the abutment member with the pickup housing so that the abutment member is movable relative to the pickup housing and relative to the instrument when the pickup housing is disposed in the soundhole of the instrument. The adjustment means includes: a threaded rod connected to the pickup housing; and an operator member mounted on the rod and the abutment member so that operation of the operator member moves the abutment member along the rod into abutting engagement with the instrument in response to the pickup housing being disposed in the soundhole and the operator member being operated.

The electromagnetic pickup of the present invention is also for a musical instrument having a soundhole disposed beneath a plurality of strings of the instrument. This pickup comprises first pole means for defining a first magnetic pole beneath a first plurality of the strings of the instrument (e.g., all six of the E, A, D, G, B and E strings of a conventional six-string acoustic guitar). It also comprises second pole means for defining a second magnetic pole beneath a second plurality of the strings of the instrument, wherein the second plurality is less than the first plurality (e.g., only the lower pitch E, A, D and G strings of the conventional six-string acoustic guitar). The pickup further comprises a first winding adjacent the first pole means and a second winding adjacent the second pole means. The pickup in an overall assembly still further comprises a housing having the first and second pole means and the first and second windings disposed therein and adapted to be mounted in the soundhole of the instrument so that the first pole means is disposed beneath the first plurality of the strings and the second pole means is disposed beneath the second plurality of the strings. In the preferred embodiment, the first pole means includes a first magnet having a length substantially the same as the distance across the first plurality of the strings; and the second pole means includes a second magnet, which second magnet has a length substantially the same as the distance across the second plurality of the strings, whereby the second magnet is shorter than the first magnet. Each of the pole means further preferably includes an additional magnet, wherein each of these magnets is substantially the same length as the aforementioned second magnet.

Therefore, from the foregoing, it is a general object of the present invention to provide a novel and improved apparatus for mounting a pickup in a soundhole of a stringed musical instrument. It is also a general object of the present invention to provide a novel and improved electromagnetic pickup for such an instrument, which pickup in overall assembly preferably includes the aforementioned mounting apparatus. Other and further objects, features and advantages of the present invention will be readily apparent to those skilled in the art when the following description of the preferred embodiment is read in conjunction with the accompanying drawings.

DETAILED DESCRIPTION OF THE EMBODIMENT

Figure 4:
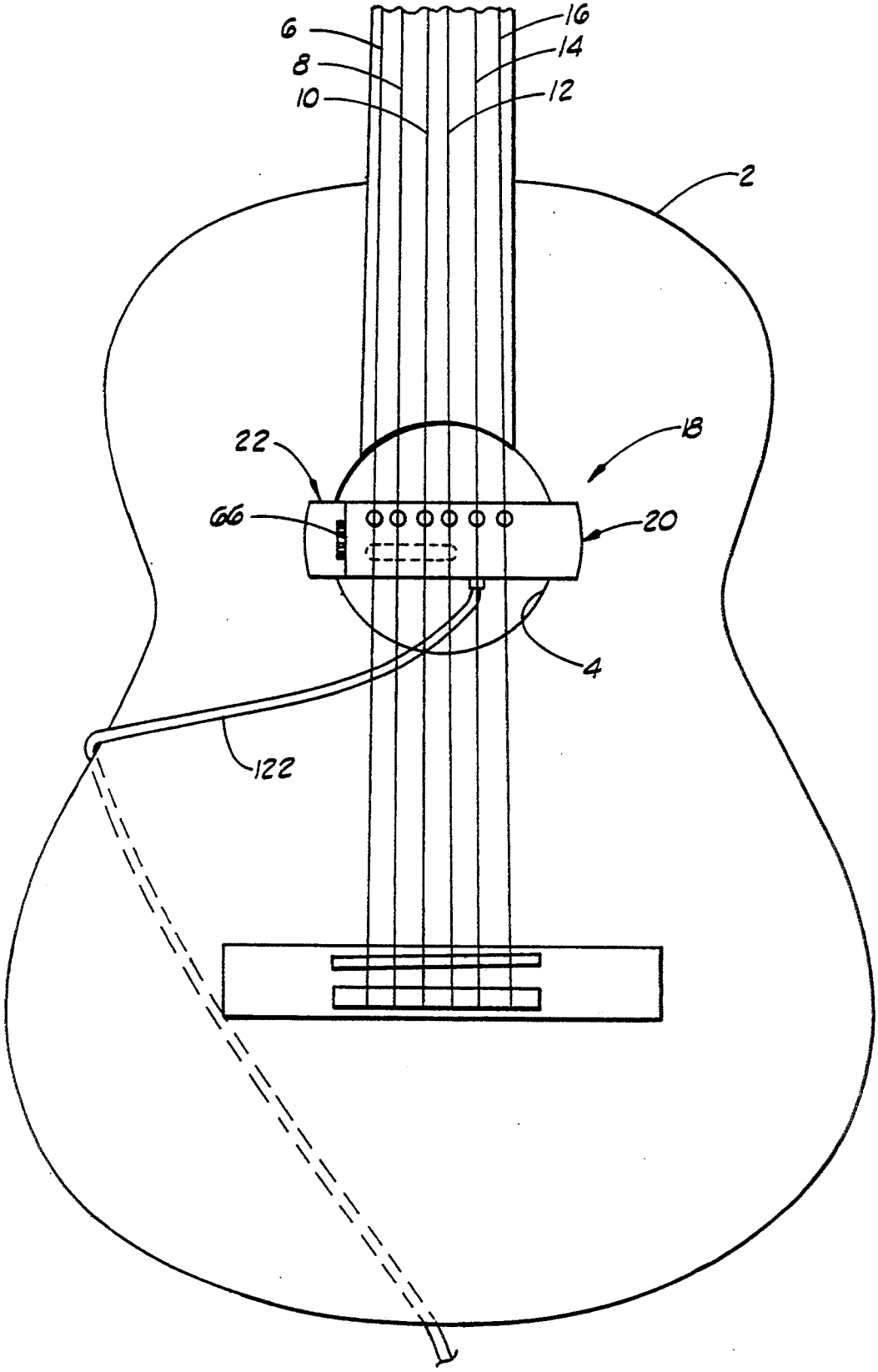
FIG. 4 is an illustration showing the preferred embodiment pickup attached to a six-string acoustic guitar.

The present invention is applicable to a stringed musical instrument having a soundhole beneath the strings. Without limiting the instruments with which the present invention can be used, the preferred embodiment will be described with reference to a six-string acoustic guitar 2 (FIG. 4) having a circular soundhole 4 beneath four lower pitch brass or bronze wrapped steel strings 6, 8, 10, 12 (E, A, D, G strings, respectively) and two higher pitch bare steel strings 14, 16 (B and E strings, respectively). An adjustable electromagnetic pickup 18 of the present invention is shown in FIG. 4 disposed in the soundhole 4 beneath the strings 6–16.

Figure 1:
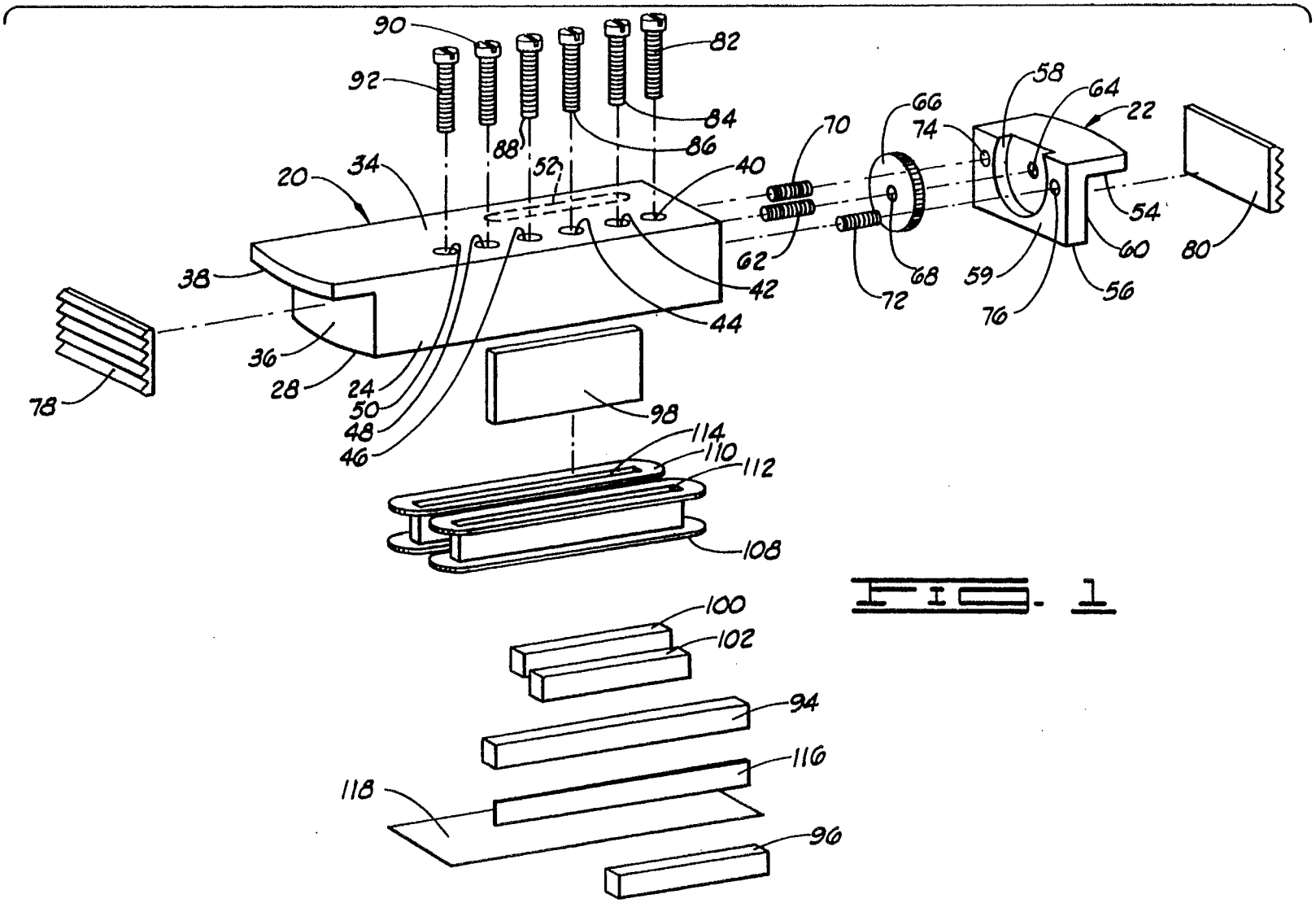
FIG. 1 is an exploded view of the preferred embodiment electromagnetic pickup, including the preferred embodiment mounting apparatus, of the present invention.
Figure 2:
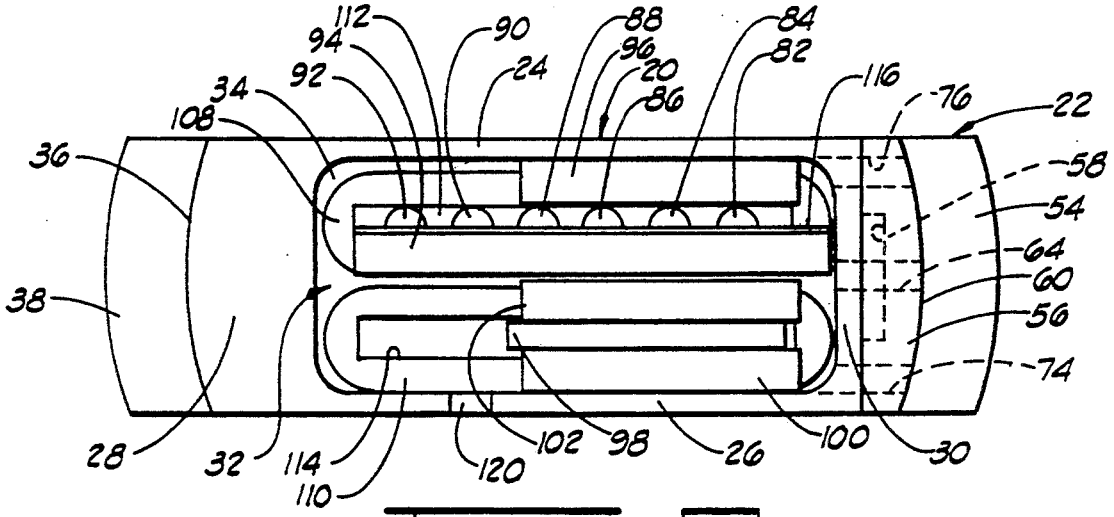
FIG. 2 is an assembled bottom view of the preferred embodiment pickup.

Referring to FIGS. 1 and 2, the adjustable electromagnetic pickup 18 of the preferred embodiment includes an apparatus for mounting the pickup on the guitar 2. This mounting apparatus includes a housing 20, an abutment member 22, and adjustment means for connecting the abutment member 22 with the housing 20 so that the abutment member 22 is movable relative to the housing 20 and relative to the guitar 2 when the housing 20 is disposed in the soundhole 4.

The housing 20 includes an integral body formed of a suitable material. Wood, such as maple, is used in a particular non-limiting (i.e., of the invention) implementation of the preferred embodiment; however, any suitable substance can be used.

Referring primarily to FIG. 2, the body of the housing 20 includes spaced, parallel side walls 24, 26 between which spaced end walls 28, 30 extend. These four walls define a cavity 32 which is substantially closed by a top wall 34. The outer surfaces of the walls 24, 26, 30, 34 are flat. An outer surface 36 of the wall 28 is curved along a suitable radius to allow the surface 36 to nest or mate better with the curved inner edge of the soundboard of the guitar 2 defining the soundhole 4. In a particular implementation, the radius of the surface 36 is two inches; however, this is not limiting of the present invention.

As shown in FIGS. 1 and 2, the top surface 34 of the housing 20 extends at one end beyond the surface 36, thereby defining a flange 38 which overlies and engages the guitar 2 soundboard in which the soundhole 4 is defined when the present invention is disposed as illustrated in FIG. 4. The opposite end of the top wall 34 terminates at the end wall 30.

Referring to FIG. 1, six holes 40, 42, 44, 46, 48, 50 are defined through the top wall 34 of the housing 20 in communication with the cavity 32. In the preferred embodiment, the six holes 40–50 are aligned parallel to the side walls 24, 26 of the housing 20, and these holes are spaced so that each is beneath a respective one of the strings 6–16 when the housing 20 is disposed in the soundhole 4.

A slot 52 is recessed in the underside of the top wall 34 in communication with the cavity 32. The slot 52 extends parallel to and is laterally spaced from holes 40, 42, 44, 46 so that it is beneath the four lowest pitch strings (i.e., strings 6, 8, 10, 12) when the housing 20 is disposed in the soundhole 4 as illustrated in FIG. 4.

This positioning of the holes 40–50 and the slot 52 relative to the strings 6–16 is obtained by mounting the pickup 18 in the soundhole 4 through the operation of the aforementioned adjustment means in moving the abutment member 22 relative to the end wall 30 of the housing 20 so that the flange 38 of the housing 20 engages the guitar 2 and a flange 54 of the abutment member 22 also engages the guitar 2. As shown in FIGS. 1 and 2, the flange 54 extends perpendicularly from an integral wall 56 of the abutment member 22, thereby giving the abutment member 22 an inverted L-shape in cross section. The wall 56 has a substantially circular recess 58 (FIG. 1) defined therein. The wall 56 has a flat inner surface 59 through which the recess 58 is defined, and the wall 56 has an outer surface 60 which is curved in a similar manner to the surface 36 to likewise readily abut the edge of the soundboard of the guitar 2 defining the circumference of the soundhole 4. The abutment member 22 is made of a suitable substance, which in the preferred embodiment is the same material of which the housing 20 is made.

The abutment member 22 is connected to the end wall 30 of the housing 20 by the adjustment means. As shown in FIG. 1, the adjustment means includes a threaded rod 62 having an end secured to the end wall 30 and having another end protruding therefrom for being received in an aperture 64 defined through the side wall 56 of the abutment member 22. The rod 62 can be made of any suitable substance. In a particular non-limiting implementation of the preferred embodiment, the rod 62 is made of brass.

The adjustment means also includes an operator member mounted on the rod 62 and the abutment member 22 so that operation of the operator member moves the abutment member 22 along the rod 62 into abutting engagement with the guitar 2 in response to the housing 20 being disposed in the soundhole 4 and the operator member being appropriately operated. In the preferred embodiment, the operator member is a circular nut 66 having a central threaded opening 68 which engages the thread of the rod 62. The nut 66 is disposed in the recess 58 of the abutment member 22. Thus, as the nut 66 is rotated on the rod 62, the nut 66 and the abutment member 22 move relative to the housing 20. The circular nut 66 can be made of any suitable material; in a particular non-limiting implementation, it is made of brass.

In the preferred embodiment, the adjustment means further includes support guide means for supporting and guiding the abutment member 22 in its movement relative to the housing 20 and the guitar 2. As shown in FIG. 1, this includes two additional rods 70, 72. Each of these is connected at one end to the end wall 30 of the housing 20. The other ends of the rods 70, 72 are slidably received in apertures 74, 76, respectively, defined through the side wall 56 of the abutment member 22. Thus, the rods 70, 72 act as guide rails to support and prevent rotation of the abutment member 22 as it moves toward or away from the housing 20 in response to rotation of the nut 66.

The abutment member 22 and the housing 20 can also be otherwise connected to prevent the abutment member 22 from becoming detached from the housing 20. For example, an elastic strap or band or the like can be secured to the end wall 30 and the wall 56, which elastic member expands or contracts with the relative movement between the abutment member 22 and the housing 20.

To enhance the engagement of the pickup 18 with the guitar 2, the preferred embodiment pickup 18 also includes grip members 78, 80 (see FIG. 1, not shown in FIG. 2) connected to end surfaces 36, 60, respectively. The grip members 78, 80 are made of any suitable material, such as rubber.

The pickup 18 further comprises first pole means for defining a first magnetic pole beneath a first plurality of the strings of the guitar. It also comprises second pole means for defining a second magnetic pole beneath a second plurality of the strings of the guitar, wherein the second plurality is less than the first plurality. In the preferred embodiment shown in FIG. 1, the first pole means includes six pole pieces 82, 84, 86, 88, 90, 92 disposed in the holes 40, 42, 44, 46, 48, 50, respectively. In a particular non-limiting implementation, these are cold rolled steel adjustable screws of a conventional type known in the art. To set respective string volume as known in the arts each of these can be adjusted independently of the others and with regard to its respective overlying one of the strings 6–16 in relation to when the pickup 18 is attached to the guitar 2 as illustrated in FIG. 4.

The first pole means of the preferred embodiment also includes a pair of magnets 94, 96. It is noted that the magnet 94 is longer than the magnet 96, which is important to the present invention as will be explained further hereinbelow. The magnets 94, 96 may be made of any suitable substance as known in the art. In the preferred embodiment it is desired to use magnets which provide a maximum output but which are non-conductive so that the pickup is more resistant to hum. In a particular non-limiting implementation, the magnets 94, 96 are made of ceramic 5.

The second pole means of the pickup 18 includes a pole plate 98 disposed in the slot 52 of the housing 20. The pole plate 98 may be made of any suitable substance. In a particular non-limiting implementation, it is made of cold rolled steel.

Associated with the pole plate 98 and forming part of the second pole means are magnets 100, 102 which are substantially the same length as the magnet 96 ("substantially the same length" as used herein includes being the same length). The magnets 100, 102 are made of any suitable material known in the art. In the preferred embodiment it is desired to use magnets which provide a maximum output but which are non-conductive so that the pickup is more resistant to hum. In a particular non-limiting implementation, these magnets are also made of ceramic 5.

The pickup 18 still further comprises a winding 104 (FIG. 3) disposed around the six pole pieces 82–92 and a winding 106 (FIG. 3) disposed around the pole plate 98. In a particular non-limiting implementation, the winding 104 includes 7,000 turns of 44AWG magnet wire wound around a conventional coil form 108 made of a suitable material, such as molded nylon; and the winding 106 of the particular implementation includes 7,000 turns of 44AWG magnet wire wound around a conventional coil form 110 made of a suitable substance, such as molded nylon.

The assembly of the above-described pole means and winding structures will be described next with reference to FIGS. 1 and 2. As mentioned, the pole pieces 82–92 are disposed in the holes 40–50, respectively, and the pole plate 98 is disposed in the slot 52. Lower ends of the pole pieces 82–92 extend into a central channel 112 of the coil form 108. The coil form 108 is disposed in the cavity 32 of the housing 20 adjacent the underside of the top wall 34.

The lower portion of the pole plate 98 is received in a central channel 114 of the coil form 110 so that the coil form 110 is also disposed in the cavity 32 vertically (relative to the depth of the cavity 32) adjacent the undersurface of the top wall 34 and horizontally (relative to the shorter width of the cavity 32) adjacent the coil form 108. Accordingly, the windings 104, 106 wound on the coil forms 108,110, respectively, are disposed around their respective pole members within the cavity 32.

The magnets 94, 96 are disposed vertically beneath the coil form 108 (and its winding 104), adjacent the side thereof opposite the top wall 34 of the housing 20. The magnets 100, 102 are similarly disposed relative to the coil form 110 and its winding 106. Accordingly, the magnets 94, 96, 100, 102 are also disposed in the cavity 32 of the housing 20.

To reduce noise, a strip of copper tape 116 is disposed between the magnets 94, 96 in electrical contact with the pole pieces 82–92, a piece of copper tape 118 is disposed beneath the pole plate 98 and the magnets 100, 102 in contact with the copper tape 116, and these pieces 116, 118 are electrically grounded.

As shown in FIG. 2, the three shorter magnets 96, 100, 102 and a corresponding segment of the longer magnet 94 are parallel to each other and disposed adjacent their respective pole members, which are disposed beneath the four lower pitch strings 6, 8, 10, 12 when the pickup 18 is mounted on the guitar 2 (more specifically, these strings are the wrapped strings, which individually interact less with a magnetic field than a bare steel string). Only the remaining segment of the magnet 94 is adjacent pole elements associated with the higher pitch strings 14, 16 (again more significantly, each of these is a string which interacts more with a magnetic field than a brass or bronze wrapped string). With this construction, a reduced magnetic field is provided to the bare steel strings 14, 16 whereas an increased magnetic field is provided to the wrapped steel strings 6, 8, 10, 12. Thus, the increased magnetic field is associated with those strings on the guitar 2 that have less effect on a magnetic field in general. The decreased magnetic field is adjacent the remaining strings which have a greater effect on a magnetic field in general. In this way a balanced output from the pickup 18 is obtained.

Figure 3:
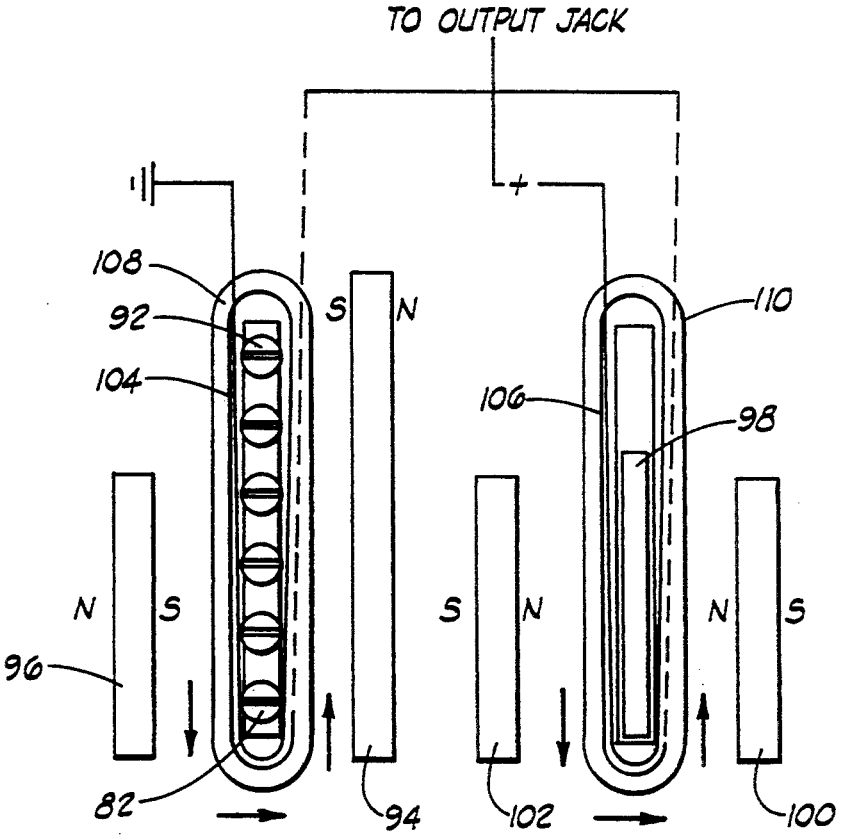
FIG. 3 is a schematic polarity diagram of the preferred embodiment pickup.

In the preferred embodiment, the longer magnet 94 has a length substantially the same as the shortest distance across all six of the strings in their normal dormant positions, whereas each of the remaining three magnets 96, 100, 102 has a length substantially the same as the shortest distance across only the four strings 6–12 in their normal dormant positions. A schematic diagram showing the windings 104, 106 connected in the preferred series linked maximum output, hum-canceling mode of the preferred embodiment and their association with the magnets 94, 96, 100, 102 is shown in FIG. 3.

Once the aforementioned assembly has been installed in the cavity 32 of the housing 20, such as by the interior of the cavity 32 being encapsulated with epoxy to pot the pickup, the mouth of the cavity 32 is preferably closed by a suitable covering, such as a layer of black rayon felt.

To connect the output of the pickup 18 into an amplification system, an output jack (not shown) is mounted inside the cavity 32. This is preferably a female connector which communicates through an opening 120 defined in the side wall 26 of the housing 20. An adapter cable, such as a shielded coaxial cable, having a right angle male plug at one end for connecting to the jack through the opening 120 and a female plug at the other end of the cable can be provided. The female plug connects to the amplification system in a conventional manner. An illustration of how such a cable can extend from the pickup 18 is illustrated in FIG. 4; the cable is marked with the reference numeral 122.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for mounting a pickup on a stringed musical instrument having a soundhole, said apparatus comprising:

a pickup housing adapted to receive a musical instrument pickup and further adapted to be disposed in a soundhole of a stringed musical instrument;

an abutment member; and adjustment means for connecting said abutment member with said pickup housing so that said abutment member is movable relative to said pickup housing and relative to the instrument when said pickup housing is disposed in the soundhole of the instrument, wherein said adjustment means includes:

a threaded rod connected to said pickup housing; and an operator member mounted on said rod and said abutment member so that operation of said operator member moves said abutment member along said rod into abutting engagement with the instrument in response to said pickup housing being disposed in the soundhole and said operator member being operated.

2. An apparatus as defined in claim 1, wherein said adjustment means further includes support guide means for supporting and guiding said abutment member in its movement relative to said pickup housing and the instrument.

3. An apparatus as defined in claim 2, wherein said support guide means includes two additional rods connected to said pickup housing and received in respective holes defined in said abutment member.

4. An apparatus as defined in claim 3, wherein said operator member is a circular nut having a threaded aperture receiving said threaded rod.

5. An apparatus as defined in claim 4, further comprising:

a first grip member connected to a first end of said pickup housing;

a second grip member connected to said abutment member; and wherein said abutment member is connected by said adjustment means to a second end of said pickup housing so that both said first and second grip members engage the instrument in response to said pickup housing being disposed in the soundhole and said circular nut being operated to move said abutment member into abutting engagement with the instrument.

6. An apparatus as defined in claim 1, wherein said operator member is a circular nut having a threaded aperture receiving said threaded rod.

7. An apparatus as defined in claim 1, further comprising:

a first grip member connected to a first end of said pickup housing;

a second grip member connected to said abutment member; and wherein said abutment member is connected by said adjustment means to a second end of said pickup housing so that both said first and second grip members engage the instrument in response to said pickup housing being disposed in the soundhole and said operator member being operated to move said abutment member into abutting engagement with the instrument.

8. An electromagnetic pickup for a musical instrument having a soundhole disposed beneath a plurality of strings of the instrument, said pickup comprising:

first pole means for defining a first magnetic pole beneath a first plurality of the strings of a musical instrument;

second pole means for defining a second magnetic pole beneath a second plurality of the strings of the instrument, wherein said second plurality is less than said first plurality;

a first winding adjacent said first pole means;

a second winding adjacent said second pole means; and a housing having said first and second pole means and said first and second windings disposed therein and adapted to be mounted in a soundhole of the instrument so that said first pole means is disposed beneath said first plurality of the strings and said second pole means is disposed beneath said second plurality of the strings.

9. An electromagnetic pickup as defined in claim 8, wherein:

said first pole means includes a first magnet, said first magnet having a length substantially the same as a distance across said first plurality of the strings; and said second pole means includes a second magnet, said second magnet having a length substantially the same as a distance across said second plurality of the strings, whereby said second magnet is shorter than said first magnet.

10. An electromagnetic pickup as defined in claim 9, wherein:

some of the strings of the instrument have less effect on a magnetic field than others of the strings of the instrument; and said first plurality of the strings includes all the strings of the instrument and said second plurality of the strings includes only those strings of the instrument that have such less effect on a magnetic field.

11. An electromagnetic pickup as defined in claim 9, wherein:

said first pole means further includes a third magnet, said third magnet having a length substantially the same as the length of said second magnet; and said second pole means further includes a fourth magnet, said fourth magnet having a length substantially the same as the length of said second magnet.

12. An electromagnetic pickup as defined in claim 9, further comprising:

an abutment member; and adjustment means for connecting said abutment member with said housing so that said abutment member is movable relative to said housing and relative to the instrument when said housing is disposed in the soundhole of the instrument, wherein said adjustment means includes:

a threaded rod connected to said housing; and an operator member mounted on said rod and said abutment member so that operation of said operator member moves said abutment member along said rod into abutting engagement with the instrument in response to said housing being disposed in the soundhole and said operator member being operated.

13. An electromagnetic pickup as defined in claim 12, wherein said adjustment means further includes support guide means for supporting and guiding said abutment member in its movement relative to said housing and the instrument.

14. An apparatus as defined in claim 13, wherein said support guide means includes two additional rods connected to said housing and received in respective holes defined in said abutment member.

15. An apparatus as defined in claim 12, wherein said operator member is a circular nut having a threaded aperture receiving said threaded rod.

16. An apparatus as defined in claim 12, further comprising:

a first grip member connected to a first end of said housing;

a second grip member connected to said abutment member; and wherein said abutment member is connected by said adjustment means to a second end of said housing so that both said first and second grip members engage the instrument in response to said housing being disposed in the soundhole and said operator member being operated to move said abutment member into abutting engagement with the instrument.

17. An adjustable electromagnetic pickup for an acoustic guitar having a soundhole beneath the strings of the guitar, said pickup comprising:

a housing having a cavity defined therein and further having a first end and a second end, said housing including a flange at said first end for engaging an acoustic guitar when said housing is disposed in a soundhole of the guitar, which guitar includes six strings of different pitch and wherein said housing further has six holes and a slot defined therein in communication with said cavity so that each of said six holes is beneath a respective one of said six strings of the guitar and the slot is beneath the four lowest pitch ones of said six strings when said housing is disposed in the soundhole;

a guitar abutment member having a recess defined therein;

adjustment means for connecting said abutment member with said second end of said housing so that said abutment member is movable relative to said housing and relative to the guitar when said housing is disposed in the soundhole of the guitar, wherein said adjustment means includes:

a threaded rod connected to said housing at said second end thereof; and a circular nut mounted on said rod and disposed in said recess of said abutment member so that rotation of said circular nut moves said abutment member along said rod into abutting engagement with the guitar when said housing is disposed in the soundhole;

six pole pieces, each of said six pole pieces disposed in a respective one of said holes of said housing;

a pole plate disposed in said slot of said housing;

a first winding disposed around said six pole pieces in said cavity of said housing;

a second winding disposed around said pole plate in said cavity of said housing, said second winding connected to said first winding;

a first magnet pair adjacent said first winding, said first magnet pair including:

a first magnet, disposed in said cavity of said housing adjacent said first winding and also adjacent said six pole pieces; and a second magnet, disposed in said cavity of said housing adjacent said first winding and also adjacent the four of said six pole pieces adapted to be disposed beneath said four lowest pitch strings of the guitar when said housing is disposed in the soundhole;

a second magnet pair adjacent said second winding, said second magnet pair including:

a third magnet, disposed in said cavity of said housing adjacent said second winding and also adjacent said pole plate; and a fourth magnet, disposed in said cavity of said housing adjacent said second winding and also adjacent said pole plate; and wherein said second, third and fourth magnets are substantially the same length and shorter than said first magnet so that an increased magnetic field is defined for said four lowest pitch strings and a decreased magnetic field is defined for the remaining two of said six strings.

18. An apparatus as defined in claim 17, wherein said adjustment means further includes two additional rods connected to said housing at said second end thereof and received in respective holes defined in said abutment member.

19. An apparatus as defined in claim 18, further comprising:

a first grip member connected to said first end of said housing beneath said flange;

a second grip member connected to said abutment member; and wherein said abutment member is connected by said adjustment means to said second end of said housing so that both said first and second grip members engage the guitar in response to the housing being disposed in the soundhole and said circular nut being rotated to move said abutment member into abutting engagement with the guitar.

* * * * *